US005336071A

United States Patent [19]

Kobayashi et al.

[11] Patent Number: 5,336,071

[45] Date of Patent: * Aug. 9, 1994

[54] AIR GUN FOR THE PRODUCTION OF NON-WOVEN FABRIC AND NON-WOVEN FABRIC PRODUCING APPARATUS

[75] Inventors: Keiji Kobayashi; Akira Kaneko; Katsuya Hata; Yoshinori Kobayashi, all of Kuga, Japan

[73] Assignee: Mitsui Petrochemical Industries, Ltd., Tokyo, Japan

[ * ] Notice: The portion of the term of this patent subsequent to Mar. 9, 2010 has been disclaimed.

[21] Appl. No.: 63,429

[22] Filed: May 19, 1993

Related U.S. Application Data

[63] Continuation of Ser. No. 669,094, Mar. 13, 1991, abandoned.

[30] Foreign Application Priority Data

Mar. 14, 1990 [JP] Japan ..... 2-63453
Mar. 14, 1990 [JP] Japan ..... 2-63454

[51] Int. Cl.[5] ..... B29C 47/00

[52] U.S. Cl. ..... 425/66; 19/299; 264/210.8; 264/211.15; 425/72.2

[58] Field of Search ..... 425/72.2, 66; 264/210.2, 345, 210.7, 210.8, 211.13, 211.14, 211.15, 211.16; 19/299

[56] References Cited

U.S. PATENT DOCUMENTS

| | | | |
|---|---|---|---|
| 2,455,174 | 11/1948 | Hih . | |
| 3,156,752 | 11/1964 | Cope | 264/345 |
| 3,302,237 | 2/1967 | Cope et al. . | |
| 3,379,811 | 4/1968 | Hartmann et al. | 425/72.2 |
| 3,436,792 | 4/1969 | Hench | 425/72.2 |
| 3,706,826 | 12/1972 | Bremner et al. | 425/72.2 |
| 3,802,038 | 4/1974 | Bauch et al. . | |
| 3,929,542 | 12/1975 | Gehrig et al. | 425/72.2 |
| 3,954,361 | 5/1976 | Page | 425/72.2 |
| 3,999,909 | 12/1976 | Schippers | 425/72.2 |
| 4,095,312 | 6/1978 | Haley . | |
| 4,202,855 | 5/1980 | Gerking et al. | 264/210.2 |
| 4,322,027 | 3/1982 | Reba . | |
| 4,340,563 | 7/1982 | Appel et al. . | |
| 4,346,504 | 8/1982 | Birk et al. | 425/66 |
| 4,780,073 | 10/1988 | Katsumi et al. | 425/72.2 |
| 4,818,466 | 4/1989 | Mente et al. | 264/210.2 |
| 4,961,695 | 10/1990 | Hirschmann et al. | 425/72.2 |
| 4,964,197 | 10/1990 | Mente et al. . | |
| 4,973,236 | 11/1990 | Hasegawa et al. | 425/72.2 |
| 5,191,680 | 3/1993 | Kaneko et al. | 19/299 |

FOREIGN PATENT DOCUMENTS

| | | |
|---|---|---|
| 2083551 | 12/1971 | France . |
| 60-151357 | 8/1985 | Japan . |
| 1423213 | 4/1976 | United Kingdom . |

*Primary Examiner*—David A. Simmons
*Assistant Examiner*—William J. Matney, Jr.
*Attorney, Agent, or Firm*—Sherman and Shalloway

[57] ABSTRACT

An air gun apparatus which permits stable, fine spinning and is capable of discharging fine filaments at a certain degree of dispersion and affording a non-woven fabric of uniform shape is provided. The air gun includes an air nozzle and an accelerator tube. The air nozzle has a filament inlet and outlet. The filaments are discharged from the filament outlet while being pulled by compressed air. The accelerator tube is formed at a specific diameter to length ratio and is connected to the air nozzle in the filament discharging direction. The non-woven fabric producing apparatus is provided with a guide tube and a separator nozzle, with an air flow rate regulator being disposed between the guide tube and the separator nozzle. The air flow rate regulator has an exhaust port for exhausting to the exterior a portion of the compressed air which is used for carrying the filaments.

16 Claims, 8 Drawing Sheets

AIR GUN FOR THE PRODUCTION OF NON-WOVEN FABRIC AND NON-WOVEN FABRIC PRODUCING APPARATUS

This application is a continuation of application Ser. No. 07/669,094, filed Mar. 13, 1991, now abandoned.

BACKGROUND OF THE INVENTION

The present invention relates to an air gun for the production of non-woven fabric as a non-woven fabric producing apparatus, particularly to an air gun and a manufacturing apparatus of the type wherein filaments as spun from spinning nozzles are taken up at high speed and delivered onto the surface of a collector such as a screen belt while being carried by an air stream.

Generally, as a non-woven fabric producing apparatus, particularly a non-woven fabric producing apparatus of the type wherein filaments as spun from spinning nozzles are taken up and delivered onto a screen belt while being carried by an air stream to form non-woven fabric (web) , there is known the apparatus shown in FIG. 8.

In such non-woven fabric producing apparatus, filaments 2 as spun from spinning nozzles 1 are taken up and delivered onto a screen belt 3 while being carried by an air stream to form non-woven fabric. The filaments 2 from the spinning nozzles 1 are first received into an inlet of an air nozzle 7. The air nozzle 7 is provided sideways with a compressed air inlet 6, and by compressed air supplied from the compressed air inlet 6 the filaments 2 are discharged in an outlet direction of air.

In the outlet direction of the air from the air nozzle 7, namely, in the filament discharging direction there are disposed the accelerator tube 8*a* connected to the air nozzle 7 and a guide tube 8*b* connected to the tube 8*a*. The filaments 2 pass through these tubes 8*a* and 8*b* while being carried by the air. To the front end of the guide tube 8*b* is connected a separator nozzle 9. The guide tube 8*b* is for conducting the filaments 2 from the accelerator tube 8*a* to the separator nozzle 9 together with compressed air and diffusing them toward the screen belt 3. The filaments 2 are dispersed to an appropriate degree by the separator nozzle 9 and are deposited on the screen belt 3, so by moving the screen belt 3 there is formed non-woven fabric.

There is also known a fibrous web forming process which is described in Japanese Patent Laid-Open No. 151357/85. According to this process, a multifilament yarn is forced to impinge on an impingement plate together with compressed air from an elongated tube and the multifilament yarn thereby disintegrated is collected in the form of sheet onto a conveyor, the compressed air being discharged forcibly from near the lower portion of the said elongated tube in a direction away from the multifilament yarn jet direction.

In the production of non-woven fabric according to such spun bond process, it is required to thin the filaments in order to improve the productivity and quality. To this end, heretofore there have been adopted (1) a method wherein the air pressure supplied to the air gun is raised to increase the flow rate of air, thereby pulling the filaments strongly, (2) a method of shortening the distance (spinning distance) from the spinning nozzle to the air gun, (3) a method of reducing the volume of filament discharged from each of many spinning nozzles, and (4) a method of increasing the spinning temperature. But in the case where productivity is the principal object, the above methods (1) and (2) are usually adopted.

However, according to the method (1), as the flow rate of air increases, the filaments are disturbed when discharged from the separator nozzle, resulting in variations in the shape of non-woven fabric deposited on the screen belt and the uniformity of the non-woven fabric being deteriorated. Further, the increase in the flow rate of air causes an increase of the running cost and an increased cost of the product obtained results. Also, the method (2) involves a problem from the standpoint of stable spinning and it is difficult to practice this method.

SUMMARY OF THE INVENTION

The present invention has been accomplished in view of the above-mentioned circumstances and it is the first object thereof to provide an air gun for the production of non-woven fabric which permits a stable, fine spinning and can afford a non-woven fabric of a uniform shape, without the fear of increase in the running cost.

It is the second object of the invention to provide a non-woven fabric producing apparatus not only capable of effecting a stable spinning operation but also capable of discharging filaments at a certain degree of dispersion and producing a non-woven fabric of a uniform shape.

In order to achieve the first object, the air gun for the production of non-woven fabric according to the present invention is for delivering filaments as spun from spinning nozzles onto the surface of a collector while carrying the filaments together with an air stream to form a non-woven fabric, and it is constructed as follows.

The air gun is provided with an air nozzle and an accelerator nozzle connected to the air nozzle in the filament discharging direction to conduct and discharge filaments from spinning nozzles, the said air nozzle having a filament inlet for receiving the filaments and a filament outlet for discharging the filaments introduced from the filament inlet, further having a compressed air inlet and a compressed air outlet, the compressed air outlet being positioned around the filament outlet and blowing off compressed air to discharge the filaments while applying a pulling force to the filaments. The inside diameter to length ratio of the accelerator tube is set in the range of between 1:20 and 1:250.

In the non-woven fabric producing apparatus of the present invention, in order to achieve the second object, filaments as spun from spinning nozzles are taken up and discharged onto the surface of a collector while carrying the filaments together with an air stream to form a non-woven fabric, and the apparatus is constructed as follows.

The non-woven fabric producing apparatus of the invention is provided with an air nozzle having a filament inlet for receiving filaments from spinning nozzles and a compressed air inlet for receiving compressed air to discharge the filaments in an air outlet direction; an accelerator tube connected to the air nozzle in the air outlet direction to conduct the filaments; a guide tube connected to the accelerator tube; and a separator nozzle connected to the front end of the guide tube for diffusing the filaments which are discharged from the guide tube together with the compressed air, toward the surface of a collector, with an air flow rate regulator being interposed between the guide tube and the separator nozzle, the air flow rate regulator having an exhaust port for discharging to the exterior a portion of the compressed air discharged from the guide tube.

BRIEF DESCRIPTION OF THE DRAWINGS

FIGS. 1 to 7 illustrate an embodiment of the present invention, of which:

FIG. 1 is a schematic view of the entire apparatus;

FIG. 2 is an enlarged sectional view of an air nozzle;

FIG. 3 is a partially sectional view of a principal portion mainly of an air flow rate regulator;

FIG. 4 is a graph showing a relation between the length of an accelerator tube and the filament size (or fineness) in a first working example;

FIG. 5 is a graph showing a relation between the pressure of air and the filament size, using different accelerator tubes, in a second working example;

FIG. 6 is a graph showing a relation between the accelerator tube length and the yarn tension in both the presence and absence of a guide tube in a third working example; and FIG. 7 is a graph showing a relation between the amount of air exhausted and the uniformity of non-woven fabric.

DETAILED DESCRIPTION OF THE INVENTION

Figure 1:
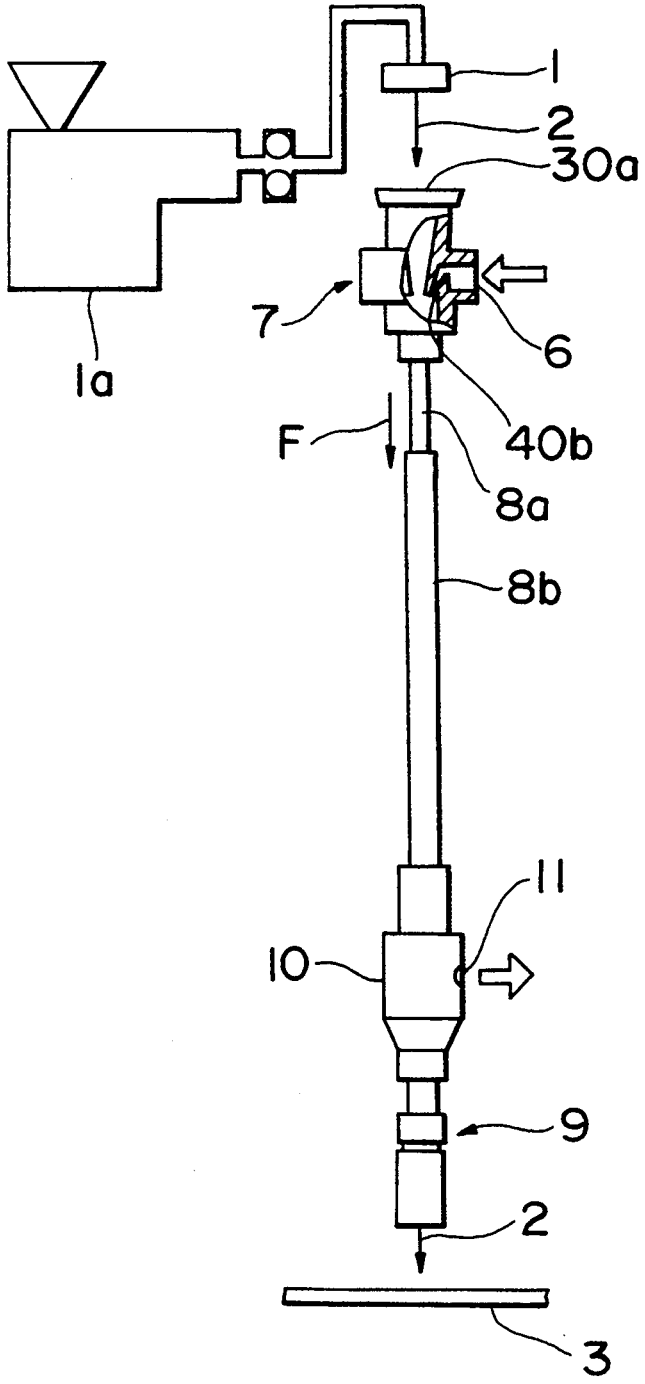
Figure 2:
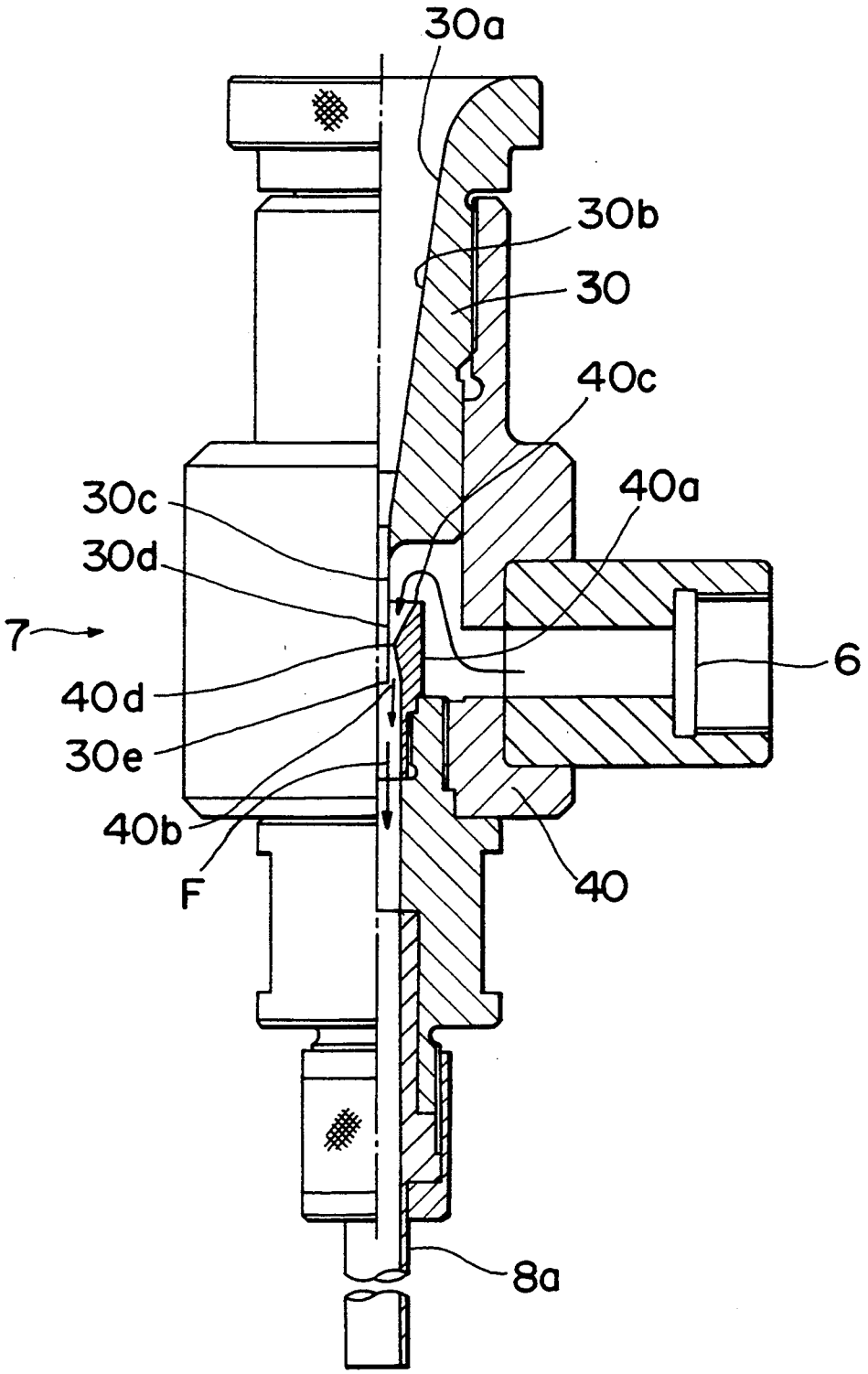
Figure 3:
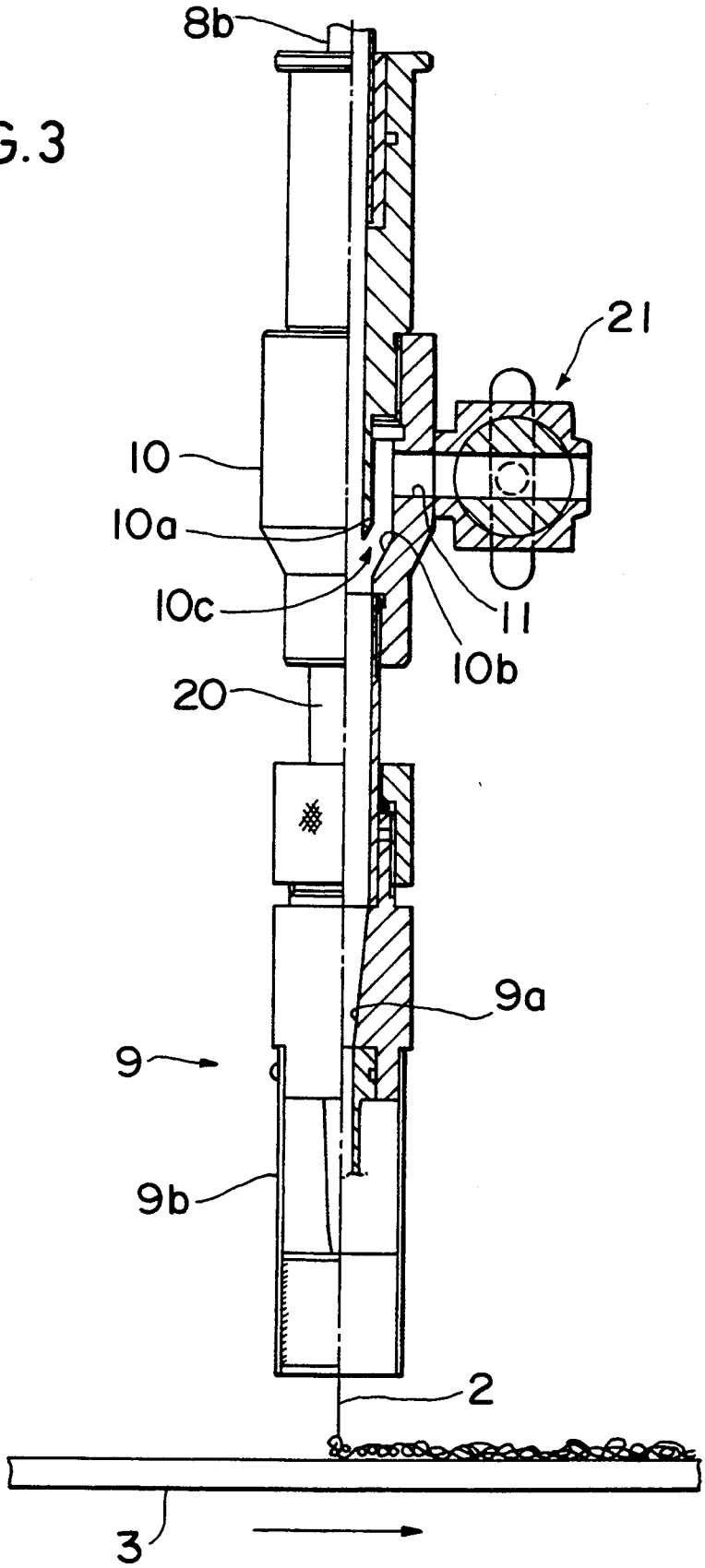

As shown in FIGS. 1 to 3, spinning is performed using a molten synthetic resin. The molten synthetic resin is extruded preferably through one or a large number of spinning nozzles 1 arranged in rows. Spun filaments 2 are usually arranged in straight rows spaced from one another.

As examples of synthetic resins employable in the invention for spinning there are mentioned polyolefins such as polyethylene and polypropylene; ethylene-vinyl compound copolymers such as ethylene-vinyl chloride copolymer; styrenic resins; polyvinyl chloride resins such as polyvinyl chloride and polyvinylidene chloride; polyacrylic esters; polyamides; and polyesters such as polyethylene terephthalate. Other synthetic resins are also employable if only they can be subjected to spinning. These synthetic resins may each be used alone or as a mixture. Appropriate amounts of inorganic or organic pigments may be incorporated therein.

An air nozzle 7 takes up a bundle of the spun filaments 2 and delivers it onto a screen belt 3. Usually, plural air nozzles 7 are arranged side by side for forming a non-woven fabric having a practical width. Generally, a large number of air nozzles 7 are arranged so that a desired overlapping of traveling paths of the filaments 2 discharged from the air nozzles 7 is attained over the whole width of the screen belt 3. The spun filaments 2 are stretched by being pulled by an air stream and are dispersed, whereby they are deposited in an entangled state on the screen belt 3.

A guide tube **8*b* may be connected to the air nozzle 7 directly, but preferably through an accelerator tube 8*a***.

It is desirable that the inner surface of the accelerator tube **8*a*** be made as smooth as possible to reduce the air resistance.

The inside diameter to length ratio of the accelerator tube **8*a*** is in the range from 1:20 to 1:250, preferably 1:50 to 1:100.

As a result, there are obtained finer filaments 2 at the same air pressure as in the prior art. But where it is desired to obtain filaments 2 of about the same size as in the prior art, it is possible to use compressed air of a lower pressure, whereby there can be attained an economic improvement.

The inside diameter to length ratio of the guide tube **8*b*** is set preferably in the range from 1:50 to 1:300.

An air flow rate regulator 10 is interposed between the guide tube **8*b* and a separator nozzle 9. The air flow rate regulator 10 functions to discharge a portion of compressed air from the guide tube 8*b* to the exterior through an exhaust port 11. In this case, a suitable amount of compressed air to be discharged is in the range of 5% to 50%, more preferably 10% to 30%, based on the total amount of compressed air supplied. If this amount is too large, the filaments 2 will stall halfway, thus making it difficult to continue the normal filament depositing operation. On the other hand, if the amount in question is too small, the provision of the air flow rate regulator 10 becomes meaningless. In this apparatus, since the compressed air supplied in the air nozzle 7 is exhausted halfway, the amount of air discharged from the separator nozzle 9 can be kept to about the same degree as in the prior art even if the pressure of the compressed air supplied in the air nozzle is increased. Consequently, not only can the filaments be pulled strongly into finer filaments, but also the filaments can be deposited uniformly onto the surface of the screen belt 3 without disturbing their dispersed state from the separator nozzle 9**.

If an air cock capable of continuously adjusting the amount of air to be discharged is mounted to the exhaust port 11, it becomes possible to finely adjust the dispersed state of the filaments 2 visually which state changes depending on the thickness and the temperature of the filaments, whereby the uniformity of the non-woven fabric obtained can be further improved.

The amount of air exhausted can be measured by a flow meter, which is mounted to the exhaust port 11. But it is more convenient to use a handy type flow meter and set to a desired flow rate while adjusting an air cock capable of changing the amount of air to be exhausted.

The air flow rate regulator 10 may be located in any position if only it is interposed between the guide tube **8*b* and the separator nozzle 9. For example, the regulator 10 and the separator nozzle 9 may be spaced from each other through a tube, or both may be connected together in a closely adjacent state. Further, the regulator 10 may be incorporated in the separator nozzle 9**.

By the air gun for the production of non-woven fabric according to the present invention the filament diameter can be reduced without increasing the air pressure supplied to the air nozzle. Consequently, a good dispersed state of filaments can be attained and so it is possible to produce a non-woven fabric of a uniform shape. Besides, since it is possible to use an air pressure of the same level as in the prior art, the production can be practiced less expensively without increase of the running cost.

According to the non-woven fabric producing apparatus of the present invention, the compressed air for the delivery of filaments is exhausted halfway, whereby there can be attained a stable dispersion of the filaments and hence it is possible to obtain a non-woven fabric of a uniform shape. Further, since it becomes possible to apply a compressed air of a higher pressure to the filaments, the filaments can be made thinner. In this case, since surplus air can be exhausted by the air flow rate regulator, the travelling path of the filaments discharged from the separator nozzle is not disturbed and it is possible to obtain a non-woven fabric of high quality.

EMBODIMENT

An embodiment of the present invention will be described below with reference to FIGS. 1 to 9.

Such a non-woven fabric producing apparatus as illustrated in FIG. 1 was constituted according to the present invention. As shown in the same figure, an air gun is constituted by an air nozzle 7 for taking up filaments spun from a spinneret 1 as an assembly of spinning nozzles 1, and an accelerator tube 8*a* connected to the air nozzle 7, and there are further provided a guide tube 8*b* connected to the accelerator tube 8*a* of the air gun, and a separator nozzle 9 connected to the front end of the guide tube 8*b* and functioning to diffuse the filaments 2 discharged from the guide tube 8b together with compressed air toward a screen belt 3 which serves as a collection surface.

The spinning nozzle assembly comprises 13,944 nozzles.

The filaments 2 dispersed by the separator nozzle 9 are deposited on the screen belt 3 to form a fibrous web.

The spinneret 1 as an assembly of spinning nozzles 1 has nine sets of sections each having 108 small holes 0.85 mm in diameter and functions to spin molten resin extruded from an extruder 1*a*.

As shown in FIG. 2, the air nozzle 7 comprises a first nozzle 30 and a second nozzle 40 connected to the first nozzle. The first nozzle 30 has a filament inlet 30*a* for receiving the filaments 2 discharged from the spinneret 1. The interior continuous to the filament inlet 30*a* comprises a tapered tube 30*b* which is reduced in diameter up to an intermediate part toward the front end of the tapered tube, and a straight tube 30*c* extending at a constant inside diameter from the front end of the tapered tube 30*b* up to a filament outlet 30*e*. The straight tube 30*c* is formed by a nozzle tube 30*d* and is in a projecting state.

In a surrounding relation to the front end of the nozzle tube 30*d* the second nozzle 40 is connected to the first nozzle 30. The second nozzle 40 has an outlet nozzle 40*a* which surrounds the front end portion of the nozzle tube 30*d*. Between the inner surface of the outlet nozzle 40*a* and the outer surface of the nozzle tube 30*d* there is formed a slight clearance, which defines a compressed air outlet 40*b* around the filament outlet 30*e* at the front end of the nozzle tube 30*d*. The inner surface of the outlet nozzle 40*a* is gradually reduced in diameter from the air inlet 40*c* side until getting over a maximum constriction 40*d*, then becomes larger in diameter gradually, and thereafter, from the portion corresponding to the filament outlet 30*e*, the inner surface diameter becomes constant as a straight tube.

On the other hand, the second nozzle 40 is provided sideways with a compressed air inlet 6, which is in communication with an air inlet 40*c* of the outlet nozzle 40*a*. The air introduced into the outlet nozzle 40*a* from the compressed air inlet 6 becomes maximum in its flow velocity when passing through the maximum constriction 40*d*, whereby the air is jetted strongly in the direction of arrow F from the compressed air outlet 40*b*, resulting in that the filaments 2 passing near the center of the nozzle tube 30*d* are pulled out strongly.

In the air outlet direction from the second nozzle 40, namely, in the delivery direction of the filaments 2, the accelerator tube 8*a* for conducting the filaments 2 is connected to the second nozzle, and to the front end of the accelerator tube 8*a* is connected the guide tube 8*b*. The guide tube 8*b* is for conducting the filaments 2 to the separator nozzle 9, which nozzle is connected to the front end of the guide tube 8*b*. The separator nozzle 9 is for diffusing the filaments 2 toward the screen belt 3 which filaments are discharged from the accelerator tube 8*a* together with compressed air.

The inside diameter and length of the accelerator tube 8*a* will hereinafter be referred to as D and L, respectively.

To the front end of the guide tube 8*b* is connected an air flow rate regulator 10. As shown in FIG. 3, the air flow rate regulator 10 is generally cylindrical and is sideways formed with an exhaust port 11. The regulator 10 has a tapered inner wall surface 10*b*. On the other hand, an inlet portion thereof continuous to the guide tube 8*b* is thin-walled at its front end 10*a*. The exhaust port 11 is in communication with the interior of the air flow rate regulator 10 through an air passage 10*c* formed between the tapered inner wall surface 10*b* of the air flow rate regulator 10 and the front end 10*a* continuous to the guide tube 8*b*. An air cock 21 is connected to the exhaust port 11 so that the amount of air discharged can be changed continuously.

By way of the conection tube 20, the separator nozzle 9 is connected to the end of outlet of the air flow rate regulater 10. The separator nozzle 9 is for diffusing the filaments 2 toward the screen belt 3 which filaments 2 are delivered with compressed air and discharged from the guide tube 8b by means of the air flow rate regulator 10. The interior continuous to the front end of the separator nozzle 9 is formed tapered which is reduced in diameter. The front end of the nozzle base 9*a* is surrounded by nozzle skirt 9*b* which is provided at the bottom of the separator nozzle 9.

Figure 7:
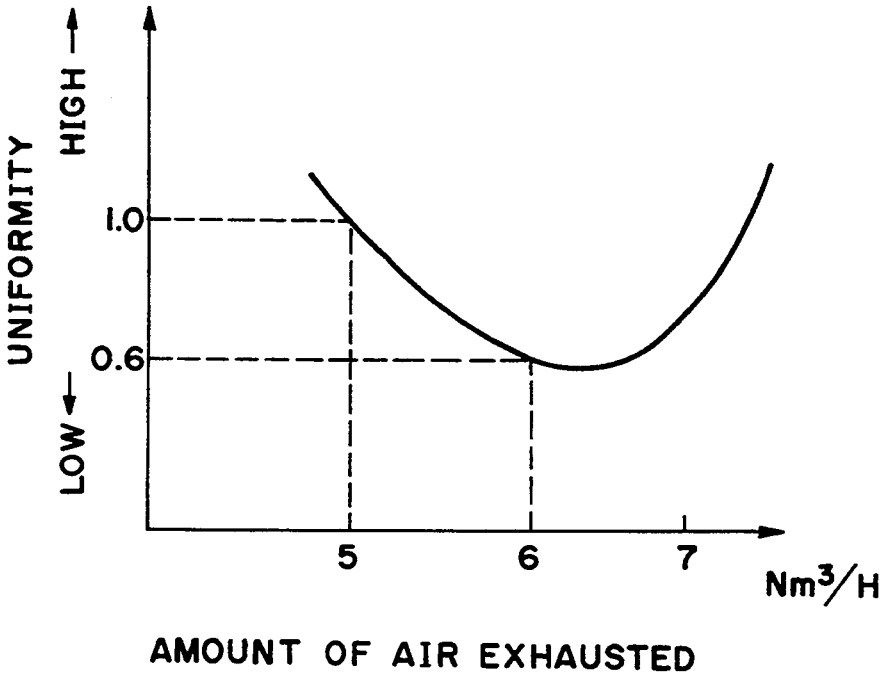
Figure 8:
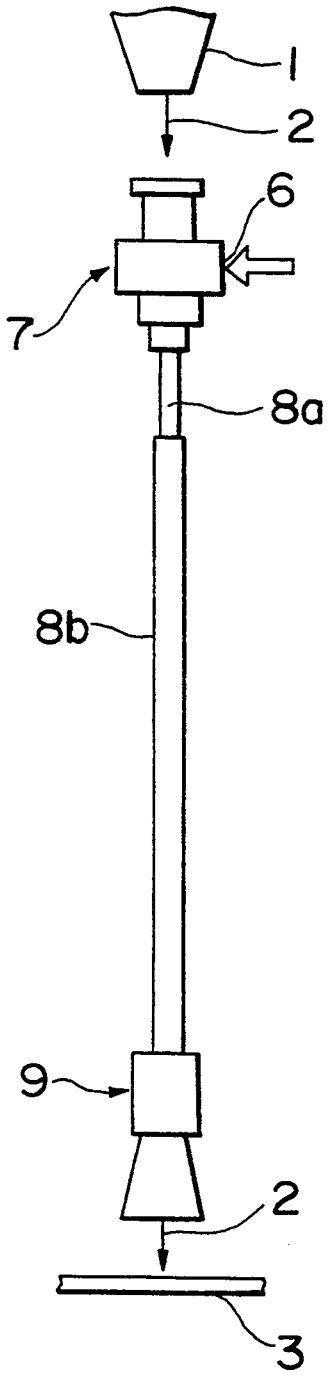
FIG. 8 (PRIOR ART)
FIG. 8 is a side view showing a conventional non-woven fabric producing apparatus.

Using the non-woven fabric producing apparatus of the above construction, filaments 2 were directed to the screen belt 3 and the uniformity of the web layer deposited on the same belt was checked to obtain such results as shown in FIG. 7. In this experiment, the amount of the material of the filaments 2 discharged was set at 550 kg/H, the pressure of the air supplied to the air nozzle 7 was set at 7 kg-G/cm$^2$, and inside diameter and length of the guide tube 8*b* were set at 6.6 mm and 280 nun, respectively. As is apparent from the results shown in FIG. 7, best results were obtained at an amount of air exhausted from the exhaust port 11 of 6.3 Nm$^3$/H. This amount of air was about 30% of the total amount of air supplied.

The measurement of uniformity was conducted by a punching method whereby the product to be measured is scooped circularly.

Measuring Implement

Scooping Punch (inside diameter:13 mm$\phi$)

Measuring Method (1) Cut off into 25 cm length after trimming each sample for measurement.

(2) Measure the weight of the sample, then on the basis of the measured weight, calculate an average weight, i.e., an average weight value (A:g/m$^2$) per unit area.

(3) Choose five relatively thick-walled points and twenty thin-walled points optionally and visually from the entire sample and punch those portions.

(4) Measure the weights of the thick-walled portions and of the thin-walled portions and calculate mean values.

(5) Then, calculate an average weight (C:g/m$^2$) of the thick-walled portions and an average weight (B:g/m$^2$) of the thin-walled portions.

Uniformity Defining Equation $$\text{Uniformity} = \frac{\text{Average weight of thick-walled portions } (C) - \text{Average weight of thin-walled portions } (B)}{\text{Average Weight } (A)}$$

As can be seen from the above equation, that the uniformity is high indicates a value close to zero.

FIRST EXAMPLE

Figure 4:
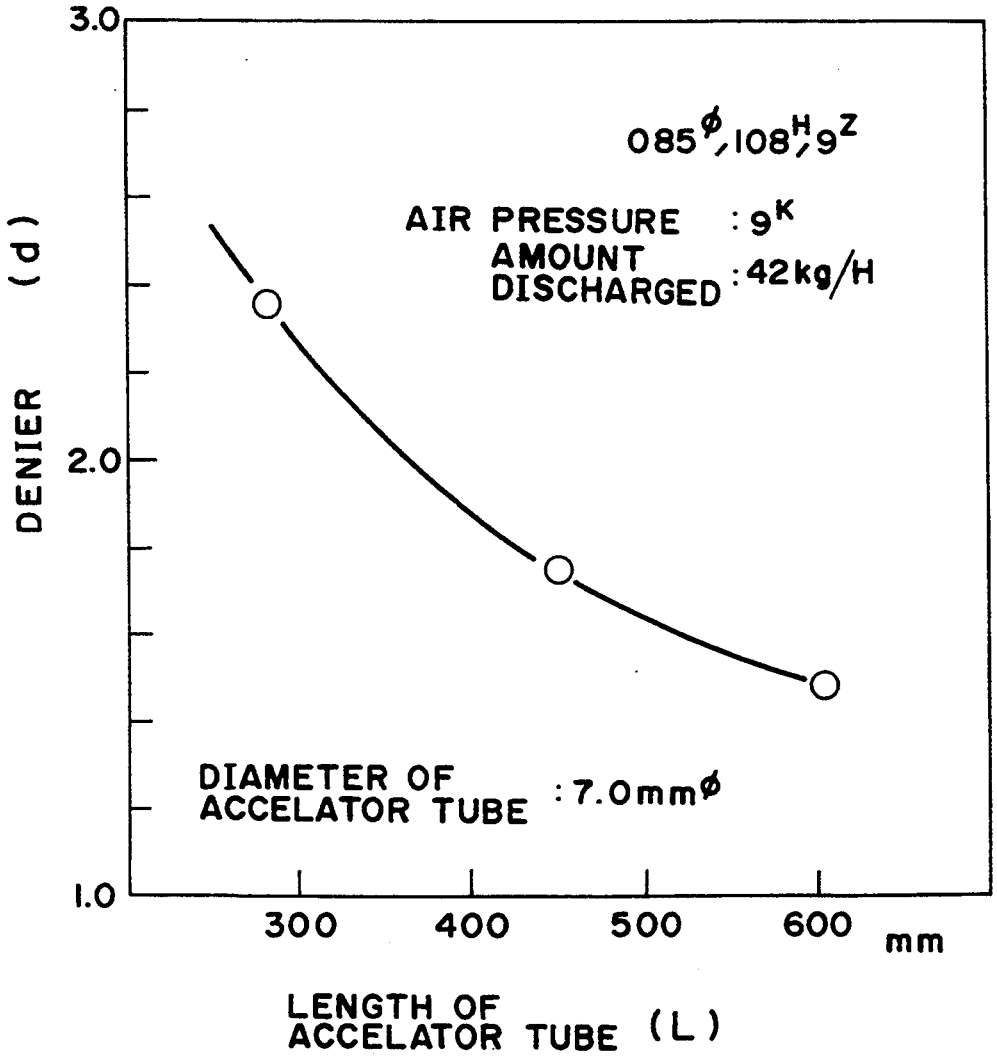

Using the non-woven fabric producing air gun of the above construction, filaments 2 were directed to the screen belt 3 and the size of the constituent filaments of the non-woven fabric deposited on the screen belt was observed and measured to obtain the results shown in FIG. 4. This experiment was conducted under the following conditions.

Material of the filaments 2: polypropylene, amount of the filaments discharged: 42 kg/H, air pressure supplied to the air nozzle 7:9 kg.G/cm$^2$, inside diameter of the accelerator tube 8*a*:7.0 mm. And the length (L) of the accelerator tube 8*a* was changed like 280 mm, 450 mm, 600 mm.

As is apparent from the results shown in FIG. 4, the size of the filaments 2 could be made smaller than 1.8 denier at an accelerator tube 8*a* length of about 450 mm or larger. In this case, the inside diameter (D) to length (L) ratio of the accelerator tube 8*a* was 1:64

SECOND EXAMPLE

An experiment was conducted under the following conditions about the influence of the shape of the accelerator tube 8*a* upon the fineness of filaments 2. Material of filaments 2: polypropylene, amount of the filaments discharged: 42 kg/H, spinneret construction: seven sets of sections each having 130 small holes 0.85 mm in diameter, spinning distance (spinning nozzle to air nozzle distance):4.5 m.

Figure 5:
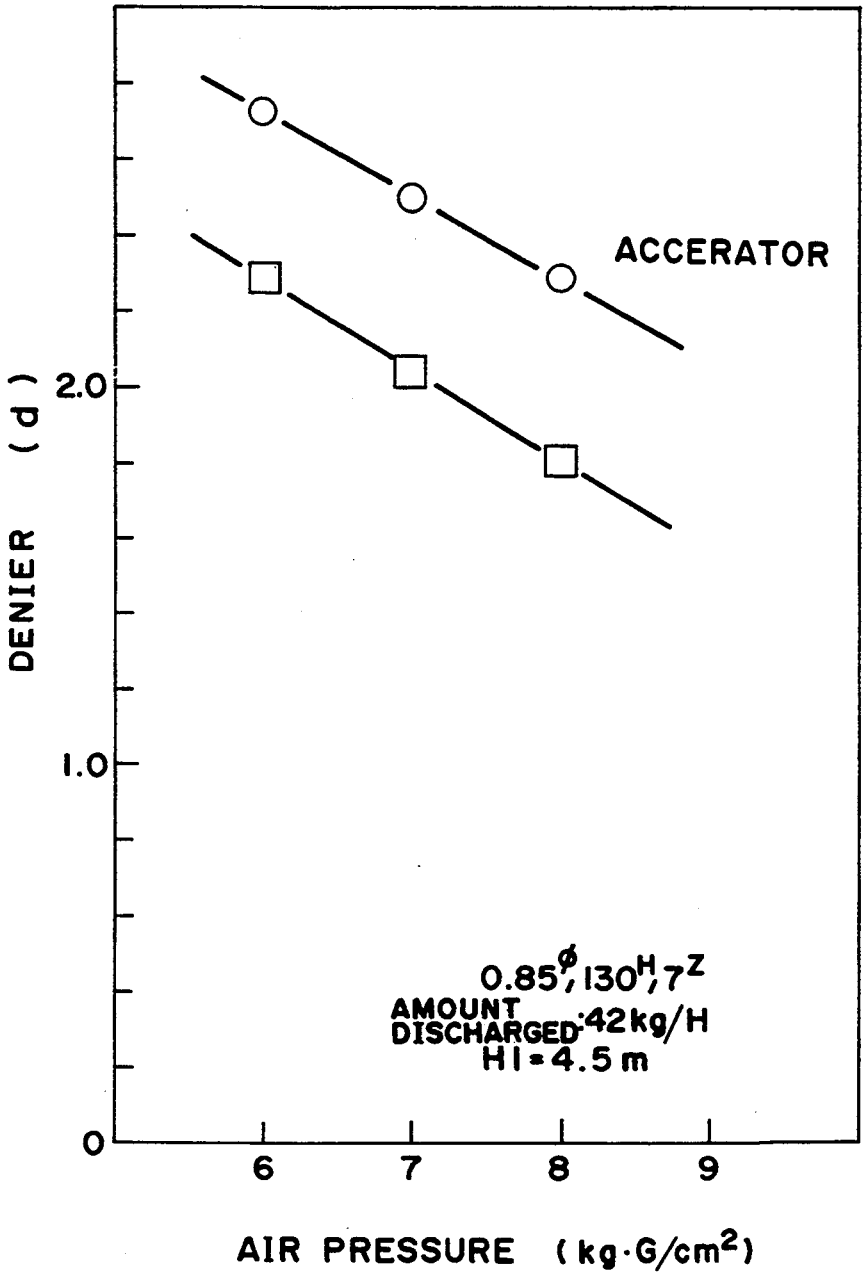

The results shown in FIG. 5 were obtained, from which it is seen that when the diameter and length of the accelerator tube 8*a* are 6.6 mm and 280 mm, respectively, (○—○ line in FIG. 5), the size of the filaments 2 is only 2.4 denier or so even at a pressure of 8 kg-G/cm$^2$ applied through the air nozzle 7, but that when the diameter and length of the accelerator tube 8*a* are 7.0 mm and 600 mm, respectively (□—□ line in FIG. 5), the filaments 2 can be made finer to 1.8 denier so even at the same pressure of 8 kg.G/cm$^2$ as above.

THIRD EXAMPLE

With respect to the case where a guide tube 8*b* 10 mm in inside diameter was connected to the accelerator tube 8*a* and the case where such guide tube was not connected to the tube 8*a*, the relation between the change in length of the accelerator tube and the yarn tension (tension applied to filaments) was observed.

Figure 6:
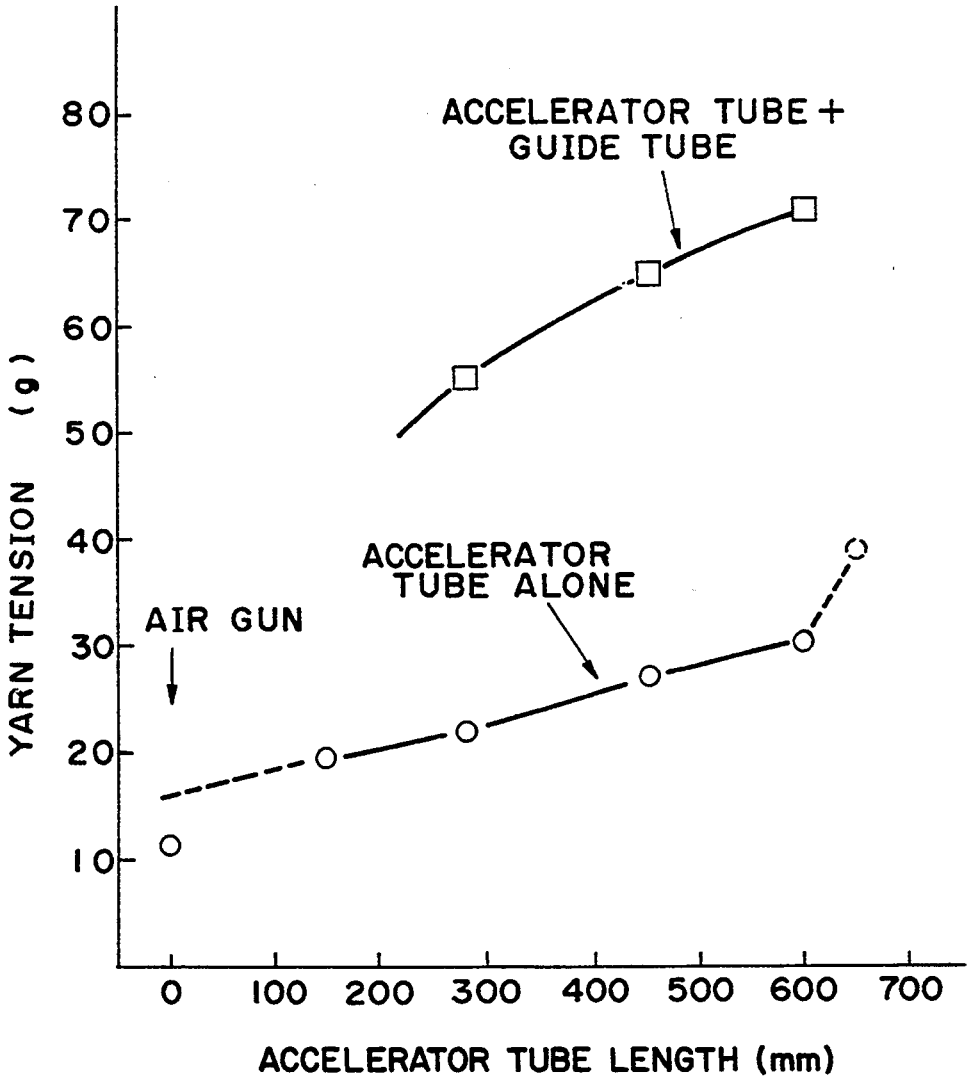

The results obtained are as shown graphically in FIG. 6. In the same figure, the ○—○ line indicates the result obtained using the accelerator tube 8*a* alone, while the □—□ line indicates the result obtained using both the accelerator tube 8*a* and the guide tube 8*b* connected thereto. It turns out that the longer the accelerator tube 8*a*, the larger the yarn tension. It is also seen that in comparison with the use of the accelerator tube 8*a* alone, a combined use thereof with the guide tube 8*b* results in increase of the pulling force.

What is claimed is:

1. An air gun for the production of a nonwoven fabric by delivering filaments as spun from a spinneret having spinning nozzles onto a screen belt while carrying the filaments together with an air stream, said air gun comprising:

(I) a first nozzle having a filament inlet for receiving filaments delivered from the spinning nozzle, including:

(a) a tapered tube in an interior of said filament inlet and reduced in diameter up to a middle portion thereof, and (b) a first generally straight tube provided in the interior of said filament inlet, having said same diameter from the middle portion to an extreme end forming a filament outlet;

(II) a second nozzle connected to said first nozzle and including:

(a) a blow port encircling a periphery of the extreme end of the first generally straight tube, an inner surface of the blow port being gradually reduced in diameter from a blow port air inlet side and then gradually increased in diameter downstream of a maximum constriction portion thereof and then forms a second generally straight tube having a slightly larger diameter than that of the filament outlet, and (b) a slight clearance formed between the inner surface of said blow port and an outer surface of said extreme end of said first generally straight tube;

(III) a compressed air inlet communicated with the blow port air inlet of the blow port, and air introduced into the blow port from the compressed air inlet increases in flow velocity to a maximum at a time passing through the maximum constriction portion having the minimum inside diameter whereby air is jetted from the compressed air blow port so as to draw the filament;

(IV) an accelerator tube, that is a straight tube having a path inside thereof for carrying filaments, connected to the second nozzle in a direction downstream of the maximum constriction portion to conduct and deliver the filaments, the inside diameter to length ratio of said accelerator tube being set in the range of between 1:50 and 1:100; and (V) an air flow rate regulator connected to the path for carrying filaments and an exhaust port branched off from said path for exhausting to the exterior a portion of the compressed air delivered from the path and an air cock connected to the exhaust port.

2. An air gun for the production of a nonwoven fabric according to claim 1, wherein the extreme end of said accelerator tube is connected to a guide tube, the inside diameter to length ratio of said guide tube being set in the range of between 1:50 and 1:300.

3. An air gun for the production of a nonwoven fabric according to claim 1, wherein said accelerator tube has a substantially smooth inner surface.

4. A nonwoven fabric producing apparatus for forming a nonwoven fabric by taking up filaments as spun from a spinneret having spinning nozzles and delivering onto a screen belt while carrying the filaments together with an air stream, said nonwoven fabric producing apparatus comprising:

(I) a first nozzle having a filament inlet for receiving filaments delivered from the spinning nozzle, including:

(a) a tapered tube in an interior of said filament inlet and reduced in diameter up to a middle portion thereof, and (b) a first generally straight tube provided in the interior of said filament inlet, having said same diameter from the middle portion to an extreme end forming a filament outlet;

(II) a second nozzle connected to said first nozzle and including:

(a) a blow port encircling a periphery of the extreme end of the first generally straight tube, an inner surface of the blow port being gradually reduced in diameter from a blow port air inlet side and then gradually increased in diameter downstream of a maximum constriction portion thereof and then forms a second generally straight tube having a slightly larger diameter than that of the filament outlet, and (b) a slight clearance formed between the inner surface of said blow port and an outer surface of said extreme end of said first generally straight tube;

(III) a compressed air inlet communicated with the blow port air inlet of the blow port, and air introduced into the blow port from the compressed aid inlet increases in flow velocity to a maximum at a time passing through the maximum constriction portion having the minimum inside diameter whereby air is jetted from the compressed air blow port so as to draw the filament;

(IV) a guide tube connected to said air nozzle to conduct the filament;

(V) an air flow rate regulator connected to the extreme end of said guide tube, having sideways an exhaust port for exhausting to the exterior a portion of the compressed air delivered from the guide tube and an air cock connected to the exhaust port; and (VI) a separator nozzle connected to the extreme end of said air flow rate regulator through a connecting tube for diffusing the filaments toward the screen belt which filaments are delivered from the guide tube together with the compressed air through said air flow rate regulator, the interior of said separator nozzle being in a tapered shape which is smaller in diameter at the extreme end thereof than the diameter of the guide tube to form a nozzle base.

5. A nonwoven fabric producing apparatus according to claim 4, including an accelerator tube having two ends wherein one end is connected to said guide tube and the other end is connected to said air nozzle.

6. A nonwoven fabric producing apparatus according to claim 4, wherein said exhaust port of said air flow rate regulator has a diameter capable of exhausting 5 to 50% of compressed air based on the total amount of the compressed air supplied.

7. A nonwoven fabric producing apparatus according to claim 4, wherein the inside diameter to length ratio of said guide tube is set in the range of between 1:50 and 1:300.

8. A nonwoven fabric producing apparatus according to claim 4, wherein said exhaust port of said air flow rate regulator has a diameter capable to exhausting 10 to 30% of compressed air based on the total amount of the compressed air supplied.

9. A nonwoven fabric producing apparatus for forming a nonwoven fabric by taking up filaments as spun from a spinneret having spinning nozzles and delivering onto a screen belt while carrying the filaments together with an air stream, said nonwoven fabric producing apparatus comprising:

(I) an air gun including:

(a) a first nozzle having a filament inlet for receiving filaments delivered from the spinning nozzle, having:

a tapered tube in an interior of said filament inlet and reduced in diameter up to a middle portion thereof, and a first generally straight tube provided in the interior of said filament inlet, having said same diameter from the middle portion to an extreme end forming a filament outlet, (b) a second nozzle connected to said first nozzle and having:

a blow port encircling a periphery of the extreme end of the first generally straight tube, an inner surface of the blow port being gradually reduced in diameter from a blow port air inlet side and then gradually increased in diameter downstream of a maximum constriction portion thereof and then forms a second generally straight tube having a slightly larger diameter than that of the filament outlet, and a slight clearance formed between the inner surface of said blow port and an outer surface of said extreme end of said first generally straight tube, (c) a compressed air inlet communicated with the blow port air inlet of the blow port, and air introduced into the blow port from the compressed air inlet increases in flow velocity to a maximum at a time passing through the maximum constriction portion having the minimum inside diameter whereby air is jetted from the compressed air blow port so as to draw the filament, and (d) an accelerator tube, that is a straight tube, connected to the second nozzle in a direction downstream of the maximum constriction portion to conduct and deliver the filaments, the inside diameter to length ratio to said accelerator tube being set in the range of between 1:50 and 1:100;

(II) a guide tube connected to the accelerator tube of said air gun to conduct the filaments;

(III) an air flow rate regulator connected to the extreme end of said guide tube, having sideways an exhaust port for exhausting to the exterior a portion of the compressed air delivered from the guide tube and an air cock connected to the exhaust port; and (IV) a separator nozzle connected to the extreme end of said air flow rate regulator through a connecting tube for diffusing the filaments toward the screen belt which filaments are delivered from the guide tube together with the compressed air through said air flow rate regulator, the interior of said separator nozzle being in a tapered shape which is smaller in diameter at the extreme end thereof than the diameter of the guide tube to form a nozzle base.

10. A nonwoven fabric producing apparatus according to claim 9, wherein the inside diameter to length ratio of said guide tube being set in the range of between 1:50 and 1:300.

11. A nonwoven fabric producing apparatus according to claim 9, wherein the inside diameter to length ratio of said accelerator tube being set in the range of between 1:50 and 1:100.

12. A nonwoven fabric producing apparatus according to claim 9, wherein said exhaust port of said air flow rate regulator has a diameter capable of exhausting 5 to 50% of compressed air based on the total amount of the compressed air supplied.

13. A nonwoven fabric producing apparatus according to claim 9, wherein said exhaust port of said air flow rate regulator has a diameter capable of exhausting 10 to 30% of compressed air based on the total amount of the compressed air supplied.

14. A nonwoven fabric producing apparatus for forming a nonwoven fabric by taking up filaments as spun from a spinneret having spinning nozzles and delivering onto a screen belt while carrying the filaments together with an air stream, said nonwoven fabric producing apparatus comprising:

(I) an air gun including:

(a) an air nozzle having a filament inlet for receiving the filaments from the spinning nozzle, a filament outlet for delivering the filaments introduced from said inlet, a compressed air inlet, and a compressed air outlet being positioned around said filament outlet and blowing off compressed air to deliver the filaments from the filament outlet while applying a pulling force to the filaments, and (b) an acclerator tube, that is a straight tube, connected to the filament outlet of said air nozzle to conduct and discharge the filaments, the inside diameter to length ratio of said accererator tube being set in the range of between 1:50 and 1:100.

(II) a guide tube connected to the extreme end of said accelerator tube of said air gun to conduct the filaments to a separator nozzle, the inside diameter to length ratio of said guide tube being set in the range of between 1:50 and 1:300;

(III) a separator nozzle connected to the extreme end of said guide tube to diffuse the filaments toward the screen belt which filaments are delivered from the guide tube together with the compressed air the separator nozzle being smaller in diameter at the extreme end thereof than the diameter of the guide tube; and (IV) an air flow rate regulator interposed between said guide tube and said separator nozzle and having an exhaust port for exhausting to the exterior a portion of the compressed air delivered from the guide tube.

15. A nonwoven fabric producing apparatus according to claim 14, wherein said exhaust port of said air flow rate regulator has a diameter capable of exhausting 10 to 30% of compressed air based on the total amount of the compressed air supplied.

16. A non-woven fabric producing apparatus for forming a non-woven fabric by taking up filaments as spun from a spinneret having spinning nozzles and discharging onto a screen belt while carrying the filaments together with an air stream, said non-woven fabric producing apparatus comprising:

an air gun including: (a) an air nozzle comprising a first nozzle and a second nozzle connected to the first nozzle, the first nozzle having a filament inlet for receiving filaments discharged from the spinneret, the interior of the first nozzle being continuous to said filament inlet comprising a tapered tube which is reduced in diameter to an intermediate part toward the front end of the tapered tube and a straight tube formed by a straight nozzle tube extending at a constant inside diameter from the front end of said tapered tube to a first filament outlet, the second nozzle having a second filament outlet at the reverse side of the filament inlet of the first nozzle and being provided sideways with a compressed air inlet and also provided with a compressed air outlet nozzle in a surrounding relation to said first filament outlet corresponding to the front end portion of said straight tube of the first nozzle so that a clearance is formed between the inner surface of said compressed air outlet nozzle and the outer surface of said straight tube, said compressed air outlet nozzle having a compressed air outlet around said first filament outlet and having an air inlet communicating with said compressed air inlet of the second nozzle, the inner surface of the compressed air outlet nozzle being gradually reduced in diameter from said air inlet side to have a maximum constriction and thereafter gradually becoming larger in diameter and finally becoming constant in diameter, and (b) an accelerator tube connected to the second filament outlet of said air nozzle to conduct and discharge the filaments, the inside diameter to length ratio of said accelerator tube being set in the range of between 1:50 and 1:100;

a guide tube connected to the accelerator tube of said air gun to conduct the filaments, wherein the inside diameter to length ratio of said guide tube is set in the range of between 1:50 and 1:300;

an air flow rate regulator connected to the front end of said guide tube, having sideways an exhaust port for exhausting to the exterior a portion of the compressed air discharged from the guide tube and an air cock connected to the exhaust port, wherein said exhaust port of said air flow rate regulator has a diameter capable of exhausting 10 to 30% of compressed air based on the total weight of the compressed air supplied; and a separator nozzle connected to the front end of said air flow rate regulator though a connecting tube for diffusing the filaments toward the screen belt which filaments are discharged from the guide tube together with the compressed air through said air flow rate regulator, the interior of said separator nozzle being in a tapered shape which is smaller in diameter at the front end thereof than the diameter of the guide tube to form a nozzle seat.

* * * * *